United States Patent [19]

Fairchild et al.

[11] 4,046,489

[45] Sept. 6, 1977

[54] AERODYNAMIC FAN BLADE

[75] Inventors: Jack E. Fairchild; Bruce E. Maurer, both of Fort Worth; Robert L. Woods, Mesquite, all of Tex.

[73] Assignee: Eagle Motive Industries, Inc., Fort Worth, Tex.

[21] Appl. No.: 616,867

[22] Filed: Oct. 8, 1975

[51] Int. Cl.[2] ..... F04D 29/38

[52] U.S. Cl. ..... 416/223 R; 416/230; 416/241 A

[58] Field of Search ..... 416/230, 241 A, 223

[56] References Cited

U.S. PATENT DOCUMENTS

| | | | |
|---|---|---|---|
| 1,622,222 | 3/1927 | Caldwell | 416/223 |
| 1,938,799 | 12/1933 | Bourne | 416/135 |
| 2,524,870 | 10/1950 | Adamtchik | 416/243 |
| 3,260,312 | 7/1966 | Elmer | 416/230 |
| 3,270,953 | 9/1966 | Jerie et al. | 416/223 X |
| 3,501,090 | 3/1970 | Stoffer et al. | 416/189 |
| 3,549,444 | 12/1970 | Katz | 156/175 |
| 3,632,460 | 1/1972 | Palfregman et al. | 156/175 |
| 3,647,317 | 3/1972 | Furlong et al. | 416/226 |
| 3,670,382 | 6/1972 | Keehan | 29/156.8 CF |

FOREIGN PATENT DOCUMENTS

| | | | |
|---|---|---|---|
| 1,503,600 | 7/1970 | Germany | 416/223 |
| 1,908,877 | 11/1969 | Germany | 416/241 A |
| 2,024,939 | 3/1971 | Germany | 416/230 |
| 2,029,021 | 12/1971 | Germany | 416/245 |
| 21,286 | 9/1966 | Japan | 416/230 |
| 638,856 | 6/1950 | United Kingdom | 416/214 |

*Primary Examiner*—Everette A. Powell, Jr.
*Attorney, Agent, or Firm*—Wofford, Felsman, Fails & Zobal

[57] ABSTRACT

Disclosed is a multi-blade fan assembly and method for manufacture, the fan assembly having a central hub having means for being attached to a driving assembly and having a plurality of fan blades connected therewith and extending radially therefrom; and further characterized by having the fan blades manufactured in accordance with subcritical aerodynamic air foil criteria so as to be efficient for moving ambient air at low relative speeds between the fan blade assembly and the air and for minimum power consumption and noise at high relative such speeds. Each of the fan blades has a length to width ratio L/W within the range of 1–9; has a length L in the range of 6–18 inches; has an artificially reduced chord thickness to length ratio within the range of 0.03–0.12; has a chord that is totally contained within a perpendicular planar cross section of the blade at the chord location and has a twist for obtaining a substantially uniform flow of air throughout the length of the blade. Also disclosed are specific preferred structural embodiments as well as the preferred method of manufacture of a fan for an internal combustion engine.

22 Claims, 6 Drawing Figures

AERODYNAMIC FAN BLADE

BACKGROUND OF THE INVENTION

1. Field of the Invention

This invention relates to fans for moving a cooling fluid in heat exchange relationship with a contained fluid. More particularly, it relates to axial flow fans for use on variable speed engines for pulling a cooling fluid, such as air, past a cooling coil, such as a radiator, responsive to rotation of a rotary part driven by the engine; the fan effecting flow of air at low speeds, yet reducing normal parasitic load and noise level on the engine at high speeds when sufficient flow passes the radiator of its own volition.

2. Description of the Prior Art

In the early stages of automotive development, construction of fans was very simple because high speeds were not attained and fan design was merely one of the minor considerations in the overall design of a "horseless carriage." With the advent of high speed automobiles and high speed automobile engines; and, particularly, with truck engines; the need for reducing the parasitic power consumption and noise of a fan at high speeds became apparent. At high speeds, the speed of the air with respect to the radiator was adequate to effect most of the desired cooling. The initial approach in this direction was that of decoupling the fan from the engine. Decoupling was effected by a variety of devices; such as, electric or magnetic clutches; operated in response to a thermally responsive element or manual control, and fluidic clutches operated responsive to temperature effects on the rheological properties of the coupling fluids. Typical of the patents relating to this area are U.S. Pat. No. Re.25,481; 3,191,733; and 3,490,686. Another approach that was employed to effect a reduced power consumption and lower noise by the fan at high speed was the use of flexible blades on the fan, alone or in conjunction with a decoupling device. Typical patents pertinent to the flexible blade structure are U.S. Pat. No. 3,698,835 and the above noted U.S. Pat. No. 3,490,686, as well as earlier patents. In these latter patents, a tapered arcuate hinge is provided with both edges touching a stiff spider arm in order to allow flexure of the blade, yet still provide stiffness, support and pitch, or angle of attack. Even the latter highly advanced and sophisticated blade, however, have not been found totally satisfactory in that it still requires too high a power consumption and noise level at high speeds, and requires a flexible but strong material, like steel, that is becoming increasingly expensive.

Moreover, all of the available fans have considerable undesirable "tip dance," or erratic movement of blade tips, at the rates of rotation above about 2,000 revolutions per minute (rpm).

From the prior art, it can be seen that no one has designed a fan blade in accordance with known aerodynamic principles for use with an automobile engine. Heretofore, it has been considered too expensive to engage in this approach, as well as the feeling by experts that this approach would not be rewarding, since the air foil so constructed would have too much lift, or forward pull, because of the Bernouli effect on the forward side of the blade. Moreover, a blade made in accordance with the prior art that would withstand the centrifugal forces involved at high speed rotation, assuming it were not disconnected, would be inordinately expensive, requiring forged metallic construction or the like. In addition, it was thought that the air flow that would have to split around the forward edge of the fan blades would be so diverted as to stall the blade because of the high camber of the blade as well as the thickness of the chords of the blade.

Accordingly, it is an object of this invention to provide an axial flow fan having fan blades that obviate the disadvantages of the prior art and provide an axial flow fan that is designed similarly as are supersonic air foils; and, consequently, has exceptionally low power consumption at all speeds, yet effects the desired airflow with unusually low noise and tip dance of the fan, even at high speeds.

It is also an object of this invention to provide a sophisticated method of manufacture and fan that will achieve a highly efficient axial flow fan that provides the foregoing object and yet is easy to manufacture, durable, maintenance free and dependable.

These and other objects will become apparent from the descriptive matter hereinafter, particularly when taken in conjunction with the drawings.

DESCRIPTION OF PREFERRED EMBODIMENTS

Figure 1:
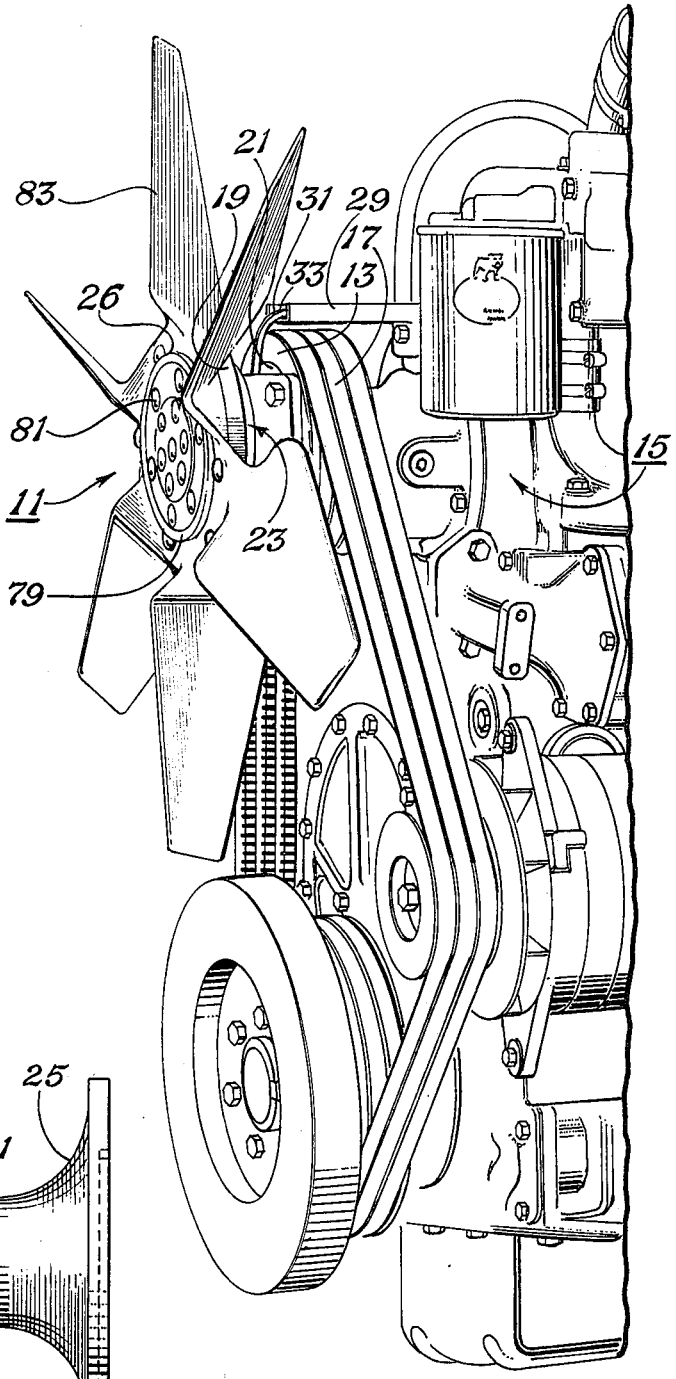
FIG. 1 is a perspective view of the front portion of an internal combustion engine employing the fan construction in accordance with an embodiment of this invention.

Referring to FIG. 1, an axial flow, aerodynamically efficient fan assembly 11 is illustrated connected with a rotary part, such as pulley 13, that is driven by the engine 15, as by fan belts 17. As illustrated, the fan assembly 11 is connected with the pulley 13 by way of an electric clutch 19. In a conventional engine, the fan assembly 11 is bolted directly to the fan mounting that is frequently integral with pulley 13, thus turns continuously with engine rotation.

Figure 2:
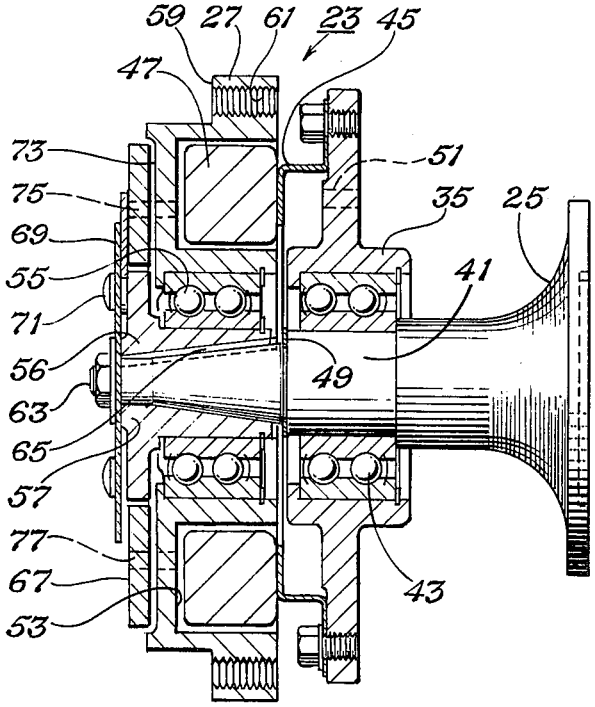
FIG. 2 is a cross sectional view of a magnetic clutch of FIG. 1 that is operable to disconnect the fan from driven engagement with the engine.

In accordance with one embodiment of this invention, an electromagnetic clutch assembly, or electric clutch, 23 bolts directly to a fan mounting 21 by means of an adapter 25, FIG. 2. The fan assembly 11 of this invention bolts directly to the housing 27 of the clutch assembly 23. The fan of this embodiment differs, however, from the conventional fan in that the diameter of the center hole 26 is larger so that it will fit on the housing 27. Bracket 29, which is attached to a suitable place on the engine 15, provides support for the coil energizing wires 31, 33. The wires 31, 33 also provide restraining means, preventing the coil support 35 from rotating. Should bearings in the clutch assembly 23 seize, friction connections (not shown) allow the wires 31, 33 to part, and the entire clutch assembly 23 will rotate without causing additional damage. This is described in detail in patent application Ser. No. 543,469, entitled "Electromagnetic Fan Clutch for a Water Cooled Vehicle Engine," filed Jan. 23, 1975 by the inventor, Robert L. Woods; and the descriptive matter of that application is incorporated by reference herein for additional details.

The following brief description of the electric clutch will be given with respect to FIG. 2. The adapter 25 may be of conical shape and contain a shaft 41 upon which the clutch assembly 23 mounts. The shaft 41 and adapter 25 may be of one piece or two pieces, suitably connected, such as by welding, as by tightening a nut, or by snap rings and key placed at the end of the shaft 41 (not shown).

The first piece to fit over the shaft 41 is coil holder 35, mounted on bearings 43. The coil holder 35 is a metal plate to which the coil base 45 and coil 47 are bolted. The coil 47 is attached to the base 45 for soldering or welding. The coil 47 is held forwardly of the coil holder 35 by the base 45. The coil 47 is a conventional toroidal shaped iron core field coil. A snap ring 49 fits into a groove on shaft 41 retaining coil 47 and coil holder 35 in place. Wires 31 and 33 for connecting current to coil 47 are inserted through an aperture 51 and prevent the coil 47 from rotating.

Housing 27 contains an annular cavity 53 into which the coil 47 is inserted. The cavity 53 is slightly larger than coil 47 such that at no time do they come into contact with each other. Housing 27 is supported on a second set of bearings 55 that fit upon the hollow shank 56 of hub 57. The housing contains a shoulder 59 which has threaded apertures 61 for bolting the fan assembly 11 to the housing 27. The housing 27 is of a material, such as aluminum, that is not attracted by the magnetic force of coil 47 when energized.

Hub 57 is rigidly attached to the shaft 41 by means of bolt 63 and key 65, in respective slots, thereby locking the shank 56 to the shaft 41. At this point, shaft 41 is tapered in order to provide additional strength to hub 57 throughout the shank 56. The hub 57 does not come into contact at any time with housing 27.

Encircling to the hub 57 is a ring, or annular shaped armature, 67. The armature 67 is attached by means of flexible flat leaf springs 69 to the hub 57 so that the armature 67 can reciprocate along the axis of the shaft 41. The springs 69 are of a spring steel and are fastened at either end by rivets 71 to the hub 57 and the armature 67. The springs 69 act as a bias means to urge the armature 67 forwardly away from the housing 27. The armature 67 is composed of a ferrous metal such that it is attracted by the magnetic field to coil 47 when energized. When not energized, the armature 67 does not come into contact with the housing 27.

In operation, when the engine is sufficiently cool, there is no current flowing to the coil 47 and no magnetic field. Shaft 41 will rotate the hub 57 and the armature 67, but the armature 67 is not in contact with housing 27. Coil 47 and the holder 35 remain stationary through restraining means comprising wires 31 and 33 and bracket 29. Housing 27 and fan 19 are free to rotate or remain stationary. Hence, they are supported by bearings. The rotation, if any, will not be that of the engine, but of motion transmitted through the bearings and ram air if the vehicle is moving and the temperature is low enough.

Once the temperature becomes sufficiently hot, energizing means comprising a temperature sensing element, which is a conventional temperature responsive solenoid (not shown) will close a contact, sending current to the coil 47.

If desired, a manual override switch may be provided in the operator's console inside the cab of the truck or the like such that the clutch can be energized or deenergized at the will of the operator. In any event, a magnetic field is generated which attracts the rotating armature 67, causing it to come into frictional contact with the face 73 of housing 27. The armature 67 acts, thus, as a clutch plate; causing the housing 27 and attached fan to rotate with the engine. A plurality of annular slots 75 and 77 are formed in the armature 67 and housing 27 to aid in dissipating heat generated by the initial friction contact between the two.

The fan assembly 11 has a central hub 79 having means, such as aperatures 81, for being attached to a driving assembly, such as the shoulder 59 of the housing 27. The hub 79 may be from 4–10 inches in diameter, preferably about 8 inches for a truck engine fan. The fan assembly 11 also includes a plurality of fan blades 83 connected with a central hub and extending radially outwardly therefrom.

Figure 4:
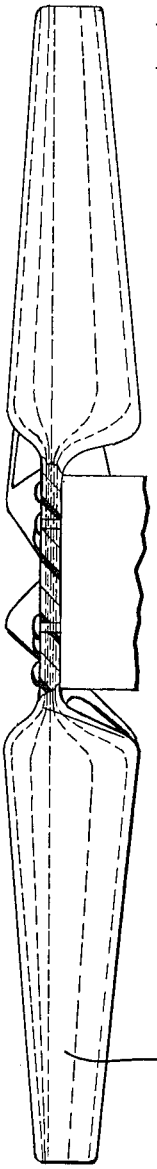
FIG. 4 is a side elevational view of the fan assembly of FIG. 3, with two blades cut away for clarity.
Figure 3:
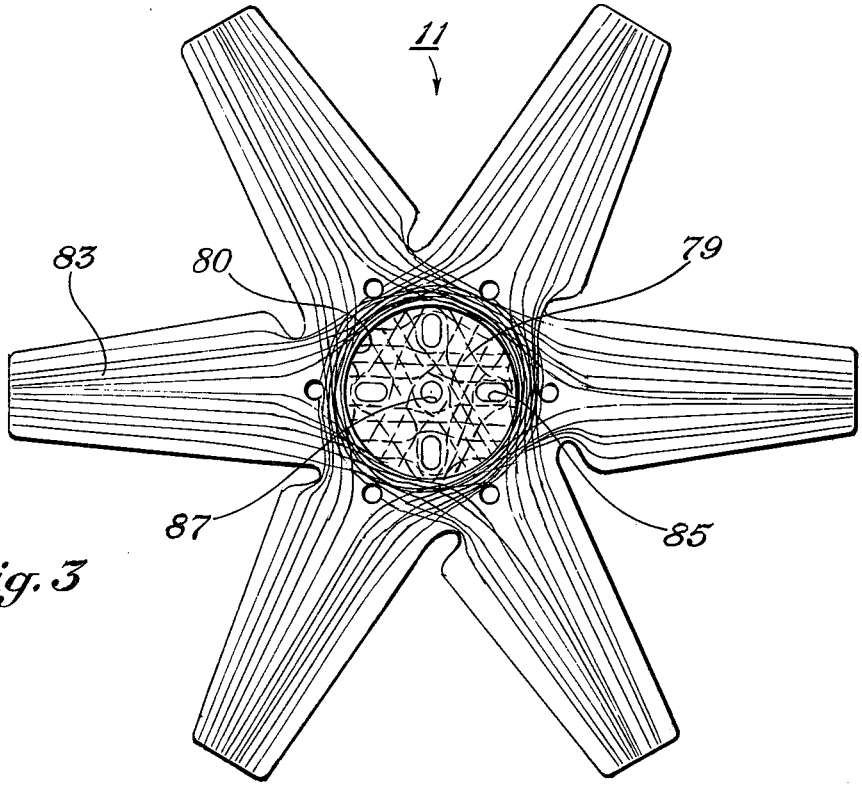
FIG. 3 is a front elevational view of another fan assembly of another embodiment of this invention but similar to that of FIG. 1.

FIGS. 3 and 4 illustrate another embodiment of this invention. The fan assembly of FIGS. 3 and 4 differs from that of FIG. 1 only that it has a more nearly conventional central hub 79 as illustrated within the circle 80. The apertures 85 and 87 are disposed to fit conventional fan mountings, instead of the electric clutch 23, delineated hereinbefore. As illustrated, the means for mounting in the fan assembly 11 of FIG. 3 comprise the four elongate apertures 85 adapted to receive bolts on a conventional rotary part. The hub section also has a central aperture 87 for receiving the pilot, or shaft. Ordinarily, a pilot will center the fan by way of aperture 87 and bolts in the elongate apertures 85 will retain the fan on the rotary part for ensuring rotation as a unit therewith.

The central hub 79, whether or not it contains the center section within the circle 80, is integrally cast with the blades 83, thereby eliminating the need for a spider as in a conventional fan assembly.

The fan blades 83 are designed similar to conventional and published criteria for subcritical airfoils, except that artificial constraints peculiar to fan criteria are imposed. Typical are those published in such texts as *Aerodynamics of the Helicopter,* Alfred Gessow and Garry C. Myers, Jr., Frederick Unger Publishing Co., New York, 1967 (Chapter 4); *Aerodynamics of Vistol Flight,* Barnes W. McCormick, Jr., Academic Press, New York, 1967 (Chapter 4).

One particularly preferred criteria is that developed by the National Aeronautic and Space Agency (NASA) and available from the U.S. Government as Summary of Airfoil Data. NACA Report No. 824, Ira H. Abott, Albert E. vonDoenhoff, and Louis S. Stivers, 1945.

A particularly preferred form is a computer program that is commercially available at the University of Texas at Arlington, Arlington, Tx., Dr. Jack Fairchild. After the constraints, or criteria, have been imposed into the program to constrain the design to that desired for the fan in accordance with those delinieated herein, the computer automatically delineates the dimensions of the mold or the like for forming each fan blade.

Figure 6:
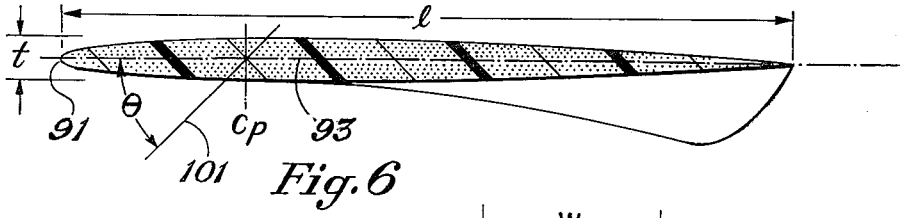
FIG. 6 is a cross sectional view of a chord of the embodiment of FIG. 5.
Figure 5:
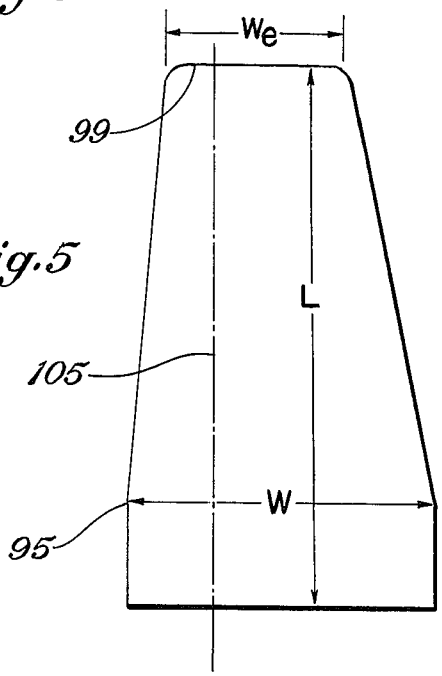
FIG. 5 is a front elevational view of a fan blade of the fan assembly of an embodiment of this invention.

Typical fan blades in accordance with a preferred embodiment of this invention are illustrated in FIGS. 5 and 6. Referring to FIG. 5, each fan blade has a length L to width W ratio L/W within the range of 1–9. Specifically, the length L will be in the range of 6–18 inches, preferably about 10 inches for a truck fan; whereas the width will be in the range of 3–8 inches, preferably about 6 inches for a truck fan. The maximum width, of course, defines the base chord length.

As illustrated in FIG. 6, each chord has a thickness $t$ to length $l$ ratio $t/l$ within the range of 0.03–0.12; and preferably about 0.08–0.05. If the thickness to length ratio becomes greater than 0.12 the fan blade is too heavy, whereas if less than 0.03, the fan blade is too thin, so there is inadequate structural strength. Particularly preferred, the ratio $t/l$ is 0.06. The center of pressure $c_p$ of each chord is located within the range of 0.2 $l$–0.3 $l$ from the front end, or leading edge, 91, of each fan blade. If the center of mass is located at less than 0.2 $l$ there is a back flutter of the blade; whereas if it is greater than 0.3 $l$, there is a tendency for the front end, or leading edge 91, of the fan blade to tuck under. Preferably, the center of mass is located at about 0.25 $l$ from the leading edge 91.

Heretofore, the fan blades have had a high degree of camber, as indicated, whether or not they had a flexible trailing edge. In the fan blade of this invention, each cross section of the fan blade totally contains therewithin the chord of the fan at that location. Specifically, as illustrated, the cross section of the fan blade is substantially symmetrical with respect to its chord 93.

As can be seen in FIG. 5, there is a chord taper in the fan blade within the range of 0.25–0.75. By "chord taper" is meant the ratio of the width $W_e$ at the end of the fan to the width W of the base chord. In the illustrated embodiment, the chord taper $W_e/W$ is about 0.5.

The chord taper need not start at any specific point along the fan, but may be influenced by design and/or manufacturing considerations. For example, the fan blades of FIG. 1 have a chord taper that begins at the root of the respective fan blades; whereas, in FIG. 5, the taper begins at the point 95, at a distance of about 2 inches on a fan blade having a length L of about 10 inches; or a proportion of the total length of about 0.2.

In order to obtain a substantially uniform flow of air along the length of the blade, and compensate for the increasing speed of radially outer portions of the fan blade, there is a twist to the fan blade. By "twist" is meant changing the respective blade pitch angle $\theta$ of the blade throughout a major portion of the length of the blade. The total twist is the difference in the blade pitch angle $\theta$ of the blade as it attaches to the hub compared with the blade pitch angle $\theta$ of the free end 99 of the blade. As illustrated, the total twist is in the range of 10°–20°; for example, about 15°. If a twist greater than about 20° is employed, there is either a tendency to go into a stall at particular blade pitch angles or the end goes into a negative angle with respect to the airstream.

The blade pitch angle, as is well recognized in the art, is the angle $\theta$, FIG. 6, made by the chord 93 at a particular cross section of the fan blade with respect to a plane 101 that is parallel with the plane of the hub 79 of the fan. The blade pitch angle is selected to prevent the fan from going into a negative angle with respect to the incoming airstream throughout the speeed range of the vehicle and the rotational speed of the engine; yet be effective in pulling air in at low speeds of a vehicle, while alleviating the large problems with stall and wasting horespower consumption of the fan blade heretofore encountered. Satisfactory performance can be obtained if the blade pitch angle $\theta$ is within the range of 25°–45° at the end of the blade adjacent the hub 79, with the blade pitch angle $\theta$ at the end 99 of the blade being within the range of 10–30° at the outer radial end farthest from the hub. It is preferred, in fact, that the blades with which data has been gathered thus far, that the blade pitch angle of the blade be within the range of 35°–45° adjacent the hub and 20°–30° adjacent the radially outermost end of the blades. The best angle that has been found thus far is a blade pitch angle of about 41° adjacent the hub and about 26° at the outermost radial end of the blades.

As will be appreciated by those skilled in the art of air foil design, the resulting fan blade is much thinner than the ordinary air foil employed; for example, in helicopter blades or in supersonic aircraft. The prior art types of designs have ordinarily been about twice as thick with respect to the length of the chords.

The respective fan blades 83 may be attached to the hub 79 by any of the usual methods; for example, as by spiders or the like. Preferably, to withstand the stresses induced by highspeed rotation, if no electric clutch is employed, it has been found desirable to integrally cast the blades and the hub together in a unitary mold with the result such as illustrated in FIGS. 1, 3 and 4.

The exact method will depend upon the materials of construction employed in the fan. For example, if metallic fan blades, such as of aluminum or steel are employed, it may be desirable to forge the integral assembly of the blades 83 and hub 79. We have found a particularly preferred form of construction to be that of using a plastic; for example, a thermosetting plastic; polymers or resins; such as, the polyacrylates, the polymethacrylates, the polymethylmethhacrylates, or phenol formaldehyde copolymers; with fiberglass fibres running longitudinally of the respective fan blades and diametrically across the entire fan assembly in order to withstand the centrifugal forces tending to throw the blades 83 off of the hub 79. The fibres are indicated by lines running longitudinally across the fan assembly; and are shown in dashed lines within the circle 80, FIG. 3, since this portion may be omitted with an electric clutch type fan assembly.

Each of the fan blades may have a substantially uniform chord taper in both the length and thickness dimensions of each of the respective chords, as illustrated and described hereinbefore. If desired for a particular reason, a non-uniform chord taper could also be employed as long as the fans were symmetrical with respect to the center of the hub and provided dynamic balance.

The leading edge 91 of each respective chord must be thinned with respect to the maximum thickness enough to prevent extreme air separation and hasten stalling of the blade.

In preparing a mold for a blade, it is preferable to form respective chords, or templates of the chords and mount these along a rod extending along the center of pressure 105, FIG. 5. This facilitates forming the receiving mold thereabout. The receiving mold is thereafter employed for casting respective fan blades after it is smoothed to the desired degree of smoothness on its interior. If desired, or course, the respective finished fan assemblies can be polished along their surfaces, particularly the surfaces of the blades. If sufficient care is taken in forming the molds, however, such polishing is not necessary and this costly step can be eliminated.

The following examples illustrate how one blade is formed and affords a feel for the relative dimensions of the respective chords and cross sectional areas of the blade at a plurality of stations therealong.

EXAMPLE I

In this example, a fan assembly was formed by integrally casting blades with a hub in a mold. The mold for each of the blades was formed by forming templates on a rod to define the negative, or receiving, mold. The table hereinafter lists a plurality of locations longitudinally along the length *l* of each respective cross sectional area at each of the respective delineated ten stations uniformly distributed along the blade. Each of the locations lengthwise of the cross sectional area contains two figures. The numerator of the figure is the distance X from the leading edge 91 of a chord to the location while the denominator is the dimension Y equal to one-half the thickness of a substantially symmetrical cross sectional shape.

| STA. | CHORD LENGTH | A | B | C | D | E | F | G | H | I | J | K | L | M | N | O | P |
|---|---|---|---|---|---|---|---|---|---|---|---|---|---|---|---|---|---|
| 0 | 6.000 | .075 | .150 | .300 | .450 | .600 | .900 | 1.200 | 1.500 | 1.800 | 2.400 | 3.000 | 3.600 | 4.200 | 4.800 | 5.400 | 5.700 |
| | | .056 | .078 | .106 | .126 | .140 | .160 | .172 | .178 | .180 | .174 | .158 | .138 | .109 | .078 | .043 | .024 |
| 1 | 6.000 | .075 | .150 | .300 | .450 | .600 | .900 | 1.200 | 1.500 | 1.800 | 2.400 | 3.000 | 3.600 | 4.200 | 4.800 | 5.400 | 5.700 |
| | | .056 | .078 | .106 | .126 | .140 | .160 | .172 | .178 | .180 | .174 | .158 | .136 | .109 | .078 | .043 | .024 |
| 2 | 6.000 | .075 | .150 | .300 | .450 | .600 | .900 | 1.200 | 1.500 | 1.800 | 2.400 | 3.000 | 3.600 | 4.200 | 4.800 | 5.400 | 5.700 |
| | | .056 | .078 | .106 | .126 | .140 | .160 | .172 | .178 | .180 | .174 | .158 | .136 | .109 | .078 | .043 | .024 |
| 3 | 5.625 | .070 | 0 | | | | | | | | | | | | | | |
| 4 | .281 | .422 | .562 | .844 | 1.125 | 1.406 | 1.687 | 2.250 | 2.812 | 3.375 | 3.937 | 4.500 | 5.062 | 5.343 | | | |
| | | .053 | .074 | .100 | .118 | .132 | .150 | .161 | .167 | .169 | .163 | .149 | .128 | .103 | .074 | .041 | .023 |
| 4 | 5.250 | .065 | .131 | .262 | .393 | .525 | .787 | 1.050 | 1.312 | 1.575 | 2.100 | 2.625 | 3.150 | 3.675 | 4.200 | 4.725 | 4.987 |
| | | .050 | .069 | .093 | .110 | .123 | .140 | .151 | .156 | .157 | .152 | .139 | .120 | .096 | .069 | .038 | .021 |
| 5 | 4.875 | .060 | .121 | .243 | .366 | .487 | .731 | .975 | 1.218 | 1.462 | 1.950 | 2.437 | 2.925 | 3.412 | 3.900 | 4.387 | 4.631 |
| | | .046 | .064 | .087 | .102 | .114 | .130 | .140 | .145 | .146 | .141 | .129 | .111 | .089 | .064 | .035 | .019 |
| 6 | 4.500 | .056 | .112 | .225 | .337 | .450 | .675 | .900 | 1.125 | 1.350 | 1.800 | 2.250 | 2.700 | 3.150 | 3.600 | 4.050 | 4.275 |
| | | .042 | .059 | .080 | .095 | .105 | .120 | .129 | .134 | .135 | .130 | .119 | .103 | .082 | .059 | .033 | .018 |
| 7 | 4.125 | .051 | .103 | .206 | .309 | .412 | .618 | .825 | 1.031 | 1.237 | 1.650 | 2.062 | 2.475 | 2.837 | 3.300 | 3.712 | 3.918 |
| | | .039 | .054 | .073 | .087 | .096 | .110 | .118 | .123 | .124 | .120 | .109 | .094 | .075 | .054 | .030 | .017 |
| 8 | 3.750 | .046 | .093 | .187 | .281 | .375 | .562 | .750 | .937 | 1.125 | 1.500 | 1.875 | 2.250 | 2.625 | 3.000 | 3.375 | 3.562 |
| | | .035 | .049 | .067 | .079 | .088 | .100 | .108 | .111 | .113 | .109 | .099 | .085 | .069 | .049 | .027 | .015 |
| 9 | 3.375 | .042 | .084 | .168 | .253 | .337 | .506 | .675 | .843 | 1.012 | 1.350 | 1.687 | 2.025 | 2.362 | 2.700 | 3.037 | 3.206 |
| | | .032 | .044 | .060 | .071 | .080 | .090 | .097 | .100 | .101 | .098 | .089 | .077 | .062 | .044 | .024 | .014 |
| 10 | 3.000 | .037 | .075 | .150 | .225 | .300 | .450 | .600 | .750 | .900 | 1.200 | 1.500 | 1.800 | 2.100 | 2.400 | 2.700 | 2.850 |
| | | .028 | .039 | .053 | .063 | .070 | .080 | .086 | .089 | .090 | .087 | .079 | .068 | .055 | .039 | .022 | .012 |

In the initial embodiments, the fans were attached to the hub at respective angles of 36° adjacent the hub and 21° at the radially outermost end of the respective blades. This blade performed satisfactorily.

EXAMPLE II

The same fan blades as described hereinbefore were formed, but were attached to the hub at respective angles of 41° at the end adjacent the hub and 26° at the outermost end.

From the foregoing, it can be seen that the fan assembly of this invention accomplishes the objects delineated hereinbefore; and, specifically, provides an economically manufactured fan blade that is highly efficient in creating a flow of air with low lift, causing low thrust on the shaft bearings; yet is economical to maintain and wastes very little horespower at high speeds of rotation. The fan blades and the fan blade assembly of this invention alleviate the difficulties and disadvantages of the prior art and provide an economical fan blade that is easily maintained and installed, whether or not it is employed in conjunction with an electric clutch.

Although this invention has been described with a certain degree of particularity, it is understood that the present disclosure is made only by way of example and that numerous changes in the details of construction and the combination and arrangement of parts may be resorted to without departing from the spirit and the scope of this invention.

What is claimed is:

1. In a multi-blade fan assembly for effecting flow of air in heat exchange relationship with a contained fluid responsive to a driving assembly for effecting rotation, and including:

a. a central hub having means for being attached to the driving assembly; and b. a plurality of fan blades connected with said central hub and extending radially therefrom; the improvement comprising:

c. having said fan blades manufactured in accordance with modified subcritical aerodynamic airfoil criteria so as to be efficient for moving ambient air at low relative speeds between said fan blade assembly and air and for minimum power consumption at high relative said speeds; each said fan blade having a length to width ratio L/W within the range of 1–9, where L is the length of the blade from its base to its tip and W is the width of the blade at its widest point; each said fan blade having a length L within the range of 6–18 inches; having thin airfoil leading and trailing edges; said leading edge being sufficiently thin that said blade does not stall due to the high degree of separation of said air stream encountering the leading edge of said blade; and having a chord that is totally contained within a planar cross section of the blade at said chord, each said cross section being substantially symmetrical respect to its chord with minimum camber and lift on said blade and having its maximum thickness *t* to its length *l* ratio *t/l* within the range of 0.03–0.12; each said fan blade having a center of mass located at a position in the range of (0.2–0.3) X (length of the chord at the respective location), as measured from the forward end of the chord; each said fan blade having a chord taper throughout the range of taper in the range of 0.25–0.75; and having a twist within the range of 10°–20° for obtaining a substantially uniform flow of air throughout the length of said blade; each said fan blade having a positive angle of attack throughout said length of said blade and having a pitch angle with respect to the central plane of said hub within the range of 25°–45° at the end adjacent said hub and within the range of 10°–30° at the outer radial end farthest from said hub.

2. The fan assembly of claim 1 wherein said chord taper is about 0.5.

3. The fan assembly of claim 1 wherein said chord taper is substantially uniform throughout the range of said taper.

4. The fan assembly of claim 1 wherein said chord taper is starter at a distance 2 inches radidally exteriorly from the juncture of the outermost portion of said hub and the radially innermost end of said blade.

5. The fan assembly of claim 4 wherein said twist is about 15°.

6. The fan assembly of claim 1 wherein said twist is about 15°.

7. The fan assembly of claim 1 wherein said center of pressure is about 0.25 distance from the forward end of said chord to the rearward end thereof.

8. The fan assembly of claim 1 wherein said $t/l$ is within the range of 0.05–0.08.

9. The fan assembly of claim 8 wherein said $t/l$ is about 0.06.

10. The fan assembly of claim 1 wherein said blade pitch angle is about 41° adjacent said hub and is about 26° at said outer radial end.

11. The fan assembly of claim 1 wherein said twist is substantially uniform throughout the length of said blade.

12. The fan assembly of claim 1 wherein said L is about 10 inches.

13. The fan assembly of claim 1 wherein each said fan blade has a maximum width in the range of 3–8 inches.

14. The fan assembly of claim 13 wherein said blade has a maximum width, or base chord length, of about 6 inches.

15. The fan assembly of claim 1 wherein said fan has six blades, said hub is about 8 inches in diameter and said blades are about 10 inches long.

16. The fan assembly of claim 1 wherein each said fan blade is formed of a plastic material having fiberglass fibers running longitudinally through the blades.

17. In a multi-blade fan assembly for effecting flow of air in heat exchange relationship with a contained fluid responsive to a driving assembly for effecting rotation, and including:

a. a central hub having means for being attached to the driving assembly; and b. a plurality of fan blades connected with said central hub and extending radially therefrom; the improvement comprising:

c. having said fan blades manufactured in accordance with modified subcritical aerodynamic airfoil criteria so as to be efficient for moving ambient air at low relative speeds between said fan blade assembly and air and for minimum power consumption at high relative said speeds; each said fan blade having a length to width ratio L/W within the range of 1–3, where L is the length of the blade from its base to its tip and W is the width of the blade at its widest point; each said fan blade having a length within the range of 6–18 inches and a width W within the range of 3–8 inches; having thin airfoil leading and trailing edges, said leading edge being sufficiently thin that said blade does not stall due to the high degree of separation of said airstream encountering the leading edge of said blade; and having a chord that is totally contained within a planar cross section of the blade at said chord, each said cross section being substantially symmetrical with respect to its chord with minimum camber and lift on said blade and having its maximum thickness $t$ to its length $l$ ratio $t/l$ within the range of 0.05–0.08; each said fan blade having a center of mass located at a position of about 0.25 of its length $l$ from the leading edge of the fan and from the forward end of said chord; each said fan blade having a chord taper throughout the range of taper of about 0.5; and having a twist of about 15° for obtaining a substantially uniform flow of air throughout the length of said blade; each said fan blade having a positive angle of attack throughout said length of said blade and having a pitch angle with respect to the central plane of said hub within the range of 35°–45° adjacent said hub and 20°–30° adjacent the radially outermost end of said blade farthest from said hub.

18. The fan assembly of claim 17 wherein said chord taper is substantially uniform throughout the range of said taper and is started at a distance of about 2 inches radially exteriorly from the juncture of the outermost portion of said hub and the radially innermost end of said blade.

19. The fan assembly of claim 17 wherein said $t/l$ is about 0.06.

20. The fan assembly of claim 17 wherein said blade pitch angle is about 41° adjacent said hub and is about 26° at said outer radial end.

21. The fan assembly of claim 17 wherein said L is about 10 inches and said fan blade has a maximum width W of about 6 inches.

22. The fan assembly of claim 17 wherein said fan has six blades, said hub is about 8 inches in diameter and said blades are about 10 inches long.

* * * * *